United States Patent [19]

Yu

[11] 4,384,888

[45] May 24, 1983

[54] TREATING MOLTEN ALUMINUM

[75] Inventor: Ho Yu, Murrysville, Pa.

[73] Assignee: Aluminum Company of America, Pittsburgh, Pa.

[21] Appl. No.: 289,836

[22] Filed: Aug. 3, 1981

[51] Int. Cl.[3] ..... C22B 21/06

[52] U.S. Cl. ..... 75/68 R; 75/93 E

[58] Field of Search ..... 75/68 R, 93 E

[56] References Cited

U.S. PATENT DOCUMENTS

| | | | |
|---|---|---|---|
| 2,840,463 | 6/1958 | Stroup et al. | 75/68 |
| 3,039,864 | 6/1962 | Hess et al. | 75/67 |
| 3,737,303 | 6/1973 | Blayden et al. | 75/68 |
| 3,737,304 | 6/1973 | Blayden et al. | 75/68 |
| 3,737,305 | 6/1973 | Blayden et al. | 75/68 |
| 4,277,280 | 7/1981 | Montgrain | 75/68 R |

*Primary Examiner*—M. J. Andrews

*Attorney, Agent, or Firm*—Carl R. Lippert

[57] ABSTRACT

Molten metal, such as aluminum, is passed through a media of submerged contacting surfaces such as a filter bed. The contacting media is selected to provide a void fraction of at least one-half and a specific surface area of at least 50 sq. ft. per cubic ft. of media. The metal moving therethrough can be contacted with a gas. In the case of aluminum, the gas may be a nonreactive gas with or without a halogenaceous or chlorinaceous gas added thereto. The process removes solid, gas and metallic impurities from the molten metal and is capable of extremely long periods of operation without replacement of the contact media. Operating life is enhanced by periodic cleaning of the contact media by a high flow gas purge which disturbs the media to dislodge particles contained therein causing the particles to rise out of the media. Metal flow through the media is preferably curtailed during the purge.

15 Claims, 1 Drawing Figure

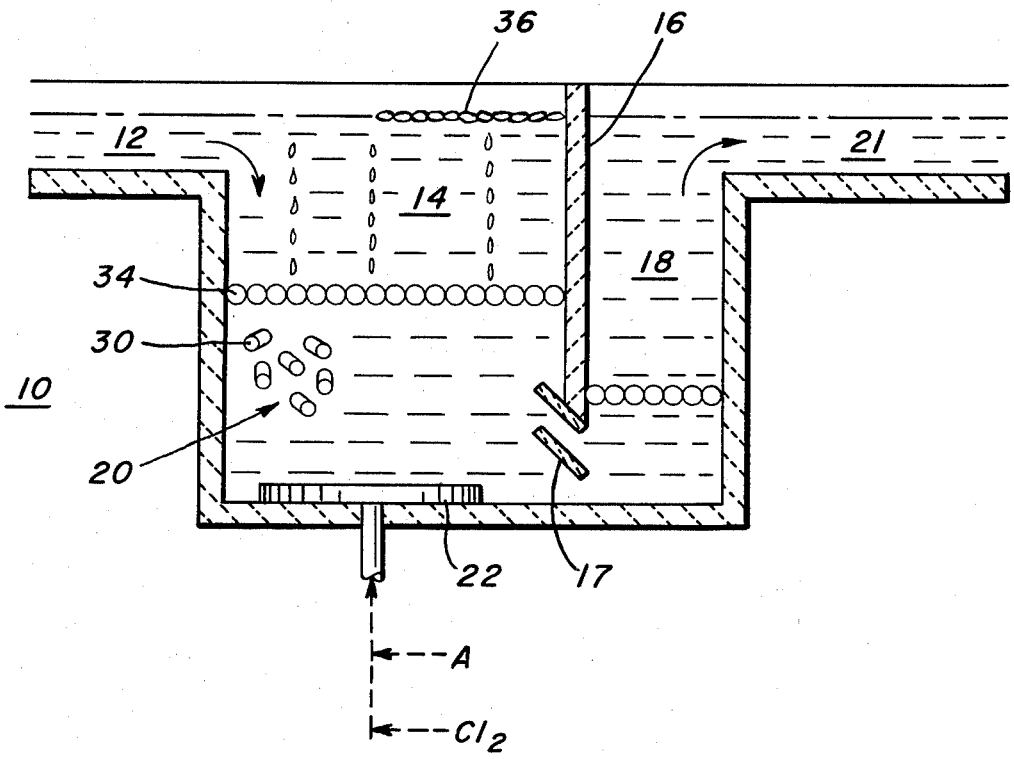
36
16
12
21
14
18
34
30
10
20
22
17
A
$Cl_2$

TREATING MOLTEN ALUMINUM

BACKGROUND OF THE INVENTION

U.S. Pat. No. 2,840,463 to Stroup et al. describes a process where molten aluminum is filtered through a bed of refractory bodies to remove suspended solids from molten aluminum. U.S. Pat. No. 3,039,864 to Hess et al. describes a process wherein argon or other nonreactive gas is passed through a bed of refractory bodies in countercurrent flow contact with molten aluminum to remove nonmetallic impurities and hydrogen gas from molten aluminum. That process was readily capable of removing high amounts of dissolved hydrogen gas, along with nonmetallic impurities, to very substantially beneficiate molten aluminum. U.S. Pat. Nos. 3,737,303, 3,737,304 and 3,737,305 to Blayden et al. describe an improvement over the process of U.S. Pat. No. 3,039,864 which provided for a very substantial increase in refractory body bed life along with other operating benefits and efficiencies and has enjoyed considerable commercial success. According to that improved process, a small amount of chlorine or other chlorinaceous gas, along with larger amounts of nonreactive fluxing gas, is passed through the refractory media in contact with the molten aluminum. The extended life according to the Blayden et al. improvement typically eliminated the need to disrupt a casting operation in order to replace the filter media which could be done during interruption for another purpose such as adjusting or repairing a casting mold. However, as the useful life of molds and other casting associated equipment was increased over the years, it became apparent that still further increases in the useful life of the filter media for molten aluminum could be highly useful in still furthering the efficiencies and productivity in processing and casting molten aluminum and other metals. Aforesaid U.S. Pat. Nos. 2,840,463, 3,039,864, 3,737,303, 3,737,304 and 3,737,305 are all incorporated herein by reference.

STATEMENT OF THE INVENTION

In accordance with the invention, molten aluminum or other molten metal is moved through a media of submerged contacting surfaces such as a filter bed. The contacting surface media is selected so as to provide a high void fraction of one-half or more and a high specific surface area such as 50 sq. ft. per cubic ft. of media. A packed bed of Interloc saddles or Raschig rings provides a suitable medium. The molten aluminum or other metal moves through the contacting medium at a low velocity and a gas may be contacted with the molten metal moving through the medium. As the molten metal travels through the medium, entrained nonmetallic particles, such as oxide particles in the case of aluminum, are effectively removed provided the metal does not move through the media at too high a velocity. After a period of operation as described, the media may be periodically purged by passing therethrough a significant quantity of gas so as to disturb the bed and dislodge therefrom impurities causing them to rise and float upon the molten metal. This practice of particle removal within the media and periodic purging and disturbance of the media to flush trapped particles therefrom has enabled the improved process to demonstrate markedly improved operating life even over that of the highly successful Blayden et al process as described in U.S. Pat. No. 3,737,305. Accordingly, it is an object of the present invention to provide for an improved process of treating molten metal to remove impurities therefrom by moving the same through a media of submerged contacting surfaces wherein the useful life of the contacting surfaces between replacement periods is extended.

Another object is to provide such a process wherein the molten metal may be contacted with a gas as it moves through said media. Another object is to provide such a process wherein replacement of the media is reduced or substantially eliminated by providing for a flushing and disturbance of the media to remove therefrom impurities contained therein.

Another object is to provide a method for removal of nonmetallic particles and gas impurities from molten aluminum utilizing a media of submerged contacting surfaces having drastically extended life.

DETAILED DESCRIPTION

In the description which follows reference is made to the FIGURE which is a schematic elevation view in cross section illustrating the present invention.

Referring to the FIGURE, molten metal enters the treatment vessel 10 through inlet 12 and passes downwardly in the down leg 14 on the inlet side of the baffle 16 which divides the vessel 10 into down leg 14 and up leg 18. In the vessel 10 is situated a zone of noncontaminating contact surface media such as a packed bed. The molten metal passes downwardly through the submerged contacting media 20 in down leg 14, passes beneath baffle 16 and then moves upwardly through up leg 18 and exits through outlet 21. As the molten metal passes through the media 20 it may be contacted with a stream of gas which enters through disperser 22. In the embodiment shown in FIG. 1 gas entering through disperser 22 rises upwardly within down leg 14 and the media zone 20 therewithin in countercurrent flow relationship with the molten metal moving downwardly through down leg 14. Downward movement of the molten metal through the contact media zone 20 is preferred, although upward movement can be utilized.

In the case of treating molten aluminum, gas introduced through disperser 22 can comprise a nonreactive gas or a halogenaceous or chlorinaceous gas or mixtures thereof. For aluminum, the nonreactive gas can be any of those disclosed in the Hess et al patent including the inert gases of the periodic table, helium, neon, argon, krypton and xenon and mixtures thereof, with argon being preferred because of its cost and availability. In addition, nitrogen or carbon dioxide may be employed, although precautions are often warranted to avoid the formation of nitrides, oxides, carbides or complexes thereof. All these gases are considered nonreactive in the practice of this invention for treating molten aluminum. Halogenaceous gases such as freons can be employed as well as chlorinaceous gases such as chlorine, aluminum chloride and hexachloroethane, although chlorine is a somewhat preferred chlorinaceous gas because of its cost and compatibility with existing facilities in many existing installations. A typical gas mixture could comprise major portions of argon and minor portions of chlorinaceous or halogenaceous gas such as 1 to 50, typically 1 to 10, parts of chlorinaceous or halogenaceous gas and about 99 to 50, typically 99 to 90, parts of a nonreactive fluxing gas on a volume basis. However, other mixtures can be useful, such as mixtures approaching or even exceeding equal portions of chlorinaceous or halogenaceous gas with nonreactive gas. It is desired that any gas mixture be premixed prior to entering zone 20 as indicated in the FIGURE which shows the gases being mixed before passing through disperser 22.

The amount of fluxing gas for treating molten aluminum varies from about 0.005 to about 0.5 standard cubic foot per hour (S.C.F.H.) per square inch of cross-sectional area in zone 20 in a plane normal to the gas travel, that is, the horizontal plane in the FIGURE which is normal to the upward gas flow and to the downward overall metal flow. Preferred gas flow rates are 0.015 to 0.2 SCFH per square inch. The aforementioned gas flow rates are those which apply while treating molten aluminum in accordance with the invention. As will be explained hereinbelow, a larger gas rate is employed to periodically purge zone 20. It is desired that disperser 22 occupy a substantial portion of cross section beneath the contact media zone 20 so as to provide for a wide uniform dispersion of the gases through the main contact zone 20. Thus either a large disperser 22, as depicted in FIG. 1, can be employed or a plurality of smaller dispersers. The use of wide zone gas dispersion can make it advisable to employ inclined baffles 17 beneath major baffle 16 which channels metal flow under baffle 16 in a generally downwardly-inclined fashion which reduces the amount of gas which can pass beneath baffle 16, thus tending to retain gas within main contact zone 20 where it can more advantageously contact the molten metal. Thus, it is preferred to provide laterally downwardly inclined flow means to conduct molten metal from the gas contact zone, which in the FIG. 1 embodiment is the main contact surface media zone 20. Such effectively functions to substantially reduce the amount of gas which can pass from zone 20 thus serving to conduct liquid metal flow but restricted gas flow from zone 20.

In accordance with the invention, it is important to properly select the contacting surface media 30 for main contact zone 20. A first requisite for this submerged contacting surface media is that such have a relatively high void fraction, meaning fraction of total volume which is not occupied by solid material such as the packing or submerged bodies and hence available for molten metal movement through the contact surface zone 20. The minimum value for the void fraction according to the invention should be about 0.4 or about one-half, suitably about 0.6. A preferred void fraction is about 0.7 or 0.8 or more. A void fraction of 0.6 is almost twice that of a filter bed made up of ¾-inch diameter alumina balls or a filter bed make up of fine mesh alumina particles such as −4+6 mesh (U.S. Pat. Nos. 3,737,305 and 3,039,864), each of whose void fraction is about 0.33. The high void fraction in accordance with the invention facilitates attachment of fine nonmetallic particles and other particles to the contact surfaces for removal thereof from the molten metal moving slowly through said contact zone 20.

A second requisite for the contact media 30 is that it have a high specific surface area (area per unit volume) which provides surfaces for the desired nonmetallic particle removal. In accordance with the invention, the surface area desired for the contact media is a minimum specific surface area of at least 25 sq. ft. per cu. ft., with a specific area of 50 or 75 sq. ft. per cu. ft. being more suitable and with specific areas over 80 being preferred. Specific contact media areas of over 90 sq. ft. per cu. ft. appear to provide superior results. Provided such can be accompanied by adequate void fraction, a specific area of 120 sq. ft. per cu. ft. is more preferred. The following Table 1 sets forth suitable packing materials (Interloc saddles and Raschig rings) in accordance with the invention, along with comparison materials with respect to their respective void fraction and average specific surface area. The comparison materials are those set forth in U.S. Pat. Nos. 3,737,305 and 3,039,864.

TABLE 1

| Packing | Average Bed Void Fraction | Average Specific Surface Area ($ft^2/ft^3$) |
|---|---|---|
| ½" Interloc saddles | 0.78 | 190 |
| ½" × ½" Raschig rings | 0.85 | 93 |
| ¾" diameter balls | 0.33 | 54 |
| −6 + 14 mesh particles | 0.33 | 257 |

It can be seen in the foregoing Table 1 that ¾-inch diameter balls or fine mesh particles such as those depicted in the aforesaid patents are not suited in practicing the invention. Beds made of these materials can eventually become clogged so as to cause the surface of molten metal in the inlet side 12 to rise above that shown in outlet zone 21 which is caused by the pressure drop through zone 20. In such prior practices, once the level on the inlet side 12 starts to rise excessively higher than that in the outlet zone 21, such was irreversible and steadily increased to eventually cause interruption of the operation because of inadequate molten travel through the treatment zone. The more open type bed provided by saddles or rings, however, serves the purpose of the invention. Rings may be provided by cutting pipe-like or hollow cylindrical shapes into relatively short segments.

The material selected for contact media 30, such as the Raschig rings or Interloc saddles, should not contaminate the molten metal and have a long surface life in exposure to molten metal without melting or deteriorating so as to interfere with the improved process or desired results. Where the molten metal is aluminum, typical temperatures are 1250° to 1500° F., and the media 30 should be able to withstand such. Suitable refractory materials for use with aluminum having a higher melting point than aluminum and being substantially inert toward aluminum include such substances as chromite, corundum, forsterite, magnesia spinel, periclase, silicon carbide and zircon. Alumina (synthetic corundum) is a preferred noncontaminating material for molten aluminum. Carbonaceous materials such as fashioned from used carbon anodes can also be useful with molten aluminum, although such tend to float, and some provision such as a refractory screen may be provided above zone 40 to prevent the carbonaceous material from floating out of the zone. Hence, the term "noncontaminating" is intended to include both refractory materials and even carbonaceous or other materials which may not be considered completely refractory to aluminum in the strict sense of the term "refractory" but are sufficiently stable that they do not introduce unwanted contaminants into the molten metal.

The depth of contacting media 30 is at least six inches and preferably 10 or 15 inches or more. A bed of about 20 inches is desirable. This provides desired time for contact between the molten metal and the contact media surfaces to encourage removal of nonmetallic particles and to allow for sufficient time for contact between the metal and any gases introduced into contact zone 20.

As the metal moves through contact zone 20, it is desired that the metal move at a relatively low velocity. The superficial molten metal velocity (velocity based on assuming no media or packing 30) through zone 20 is suitably less than one-half ft./minute. A slower superficial velocity of less than 0.4 or 0.3 ft./minute is preferred, for instance a superficial velocity of about one-fourth ft./minute is satisfactory. However, on a somewhat less preferred basis, molten metal velocity of up to three-fourths or one ft./minute can provide for useful results. However, for the particular arrangement depicted in FIG. 1 which shows no further significant provision for particle removal after exiting zone 20, a metal velocity of not over one-half ft./minute is considered better. Particles coalesce and are trapped in the media thus removing them from the treated molten metal, and this combined coalescence and removal effect is enhanced by relatively slow flow rates.

As indicated hereinabove, the practice of the invention includes introducing fluxing gases, including fluxing gas mixtures, into contact zone 20 for treatment of molten aluminum. Where the gas mixture includes a halogenaceous or chlorinaceous gas, such can remove trace impurity elements such as sodium and calcium as well as assist in removing oxide and dissolved gas impurities. Such gas treatments usually involve relatively slow rates such as around 0.05 SCFH per square inch of bed cross section normal to the plane of overall metal and gas movement through the bed (i.e. measured in the horizontal plane). However, the invention also includes the periodic use of gas rates two or three or more times this order so as to disturb the media 30 and purge or dislodge therefrom particles trapped or contained therein previously removed from the molten metal so as to cause said particles to rise and collect as a floating layer 36. Suitable purge gas flow rates are about 0.008 or 0.009 to about 0.6 or 0.7 or more SCFH per square inch, suitably about 0.025 to 0.35 SCFH per square inch, and adequate to disturb the media and dislodge particles therefrom. Because of the serious disturbance of the media 30 caused by such copious gas flow, it is preferred to provide some sort of overlying heavy material such as a single layer of three-quarter or one inch refractory balls 34. This prevents the relatively high gas flow rates used to purge zone 20 from forcing contact media members, such as Raschig rings or Interloc saddles 30, from being carried out of zone 20 and possibly settling back downwardly in a nonuniform and nonpacked array. Hence, the invention includes the practice of periodically purging the bed by use of a gas flow which disturbs media 30 to dislodge and remove particles therefrom. This purging can be performed at any point where convenient. For instance, it can be deferred until the molten metal level on inlet side 12 is a significant amount higher than that in exit zone 21. However, it is not necessary to wait to this point. The purging can be done at any convenient point such as during any interruption in metal flow such as during any interruption in casting or any antecedent or subsequent operation which causes a delay or interruption in molten metal movement through the improved treatment vessel 10. It is preferred that during the purging operation molten metal movement through zone 20 be interrupted such that it then becomes most convenient to perform the purge during an interruption in molten metal travel caused by antecedent or subsequent operations. However, if the associated casting operation is completely continuous and not amenable to any interruption, the ingot cast from the metal passing through zone 20 during purging might contain impurities which lower its quality. It is to be understood that it is not practical to purge a bed such as that shown in U.S. Pat. No. 3,737,305 and utilizing a bed of fine mesh refractory bodies such as 3 to 14 mesh size since the high gas flow rates are incompatible with the relatively small void fraction of such filter beds and is highly disruptive thereto. That is, the process in accordance with U.S. Pat. No. 3,737,305 involves some continuous flushing of impurities from the fine particle size filter bed. However, this continuous flushing, while effective to provide for increased bed life in that system, still allows for some accumulation of nonmetallic particles within the filter bed which eventually causes the same to exhibit increasing pressure drop and increasing buildup of molten metal head from inlet side 12 across baffle 16 to outlet side 21 whereby the level in inlet side 12 can rise several inches above outlet level 21. However, once this metal head differential starts to occur in the process according to U.S. Pat. No. 3,737,305 it is normally irreversible and leads to eventual bed replacement. The present improvement in contrast can be repeatedly purged by the high gas rate purge practice and exhibit still further and even markedly extended bed life approaching indefinite bed life in some applications. In practicing the invention extended runs with no buildup of metal head from level 12 to level 21 have been observed.

EXAMPLE

In any comparison it is, of course, advisable to use the same type of metal and metal quality (contamination or freedom from contamination) and the same flow rates and other operating conditions to provide a meaningful comparison. Such a comparison is readily apparent in the following example. In an arrangement as depicted in FIG. 1, the process as shown in U.S. Pat. No. 3,737,305 was used to purify molten aluminum. The filter bed included a portion of fine mesh (−6+14) alumina granules 13 inches deep situated upon a substrate of ¾-inch alumina balls 6 inches deep. Molten aluminum was moved through the filter bed at a superficial velocity of about 0.2 ft./minute and contacted with a mixture of 3 parts chlorine and 100 parts argon at a gas flow rate of about 0.05 SCFH per square inch of bed cross section in the horizontal plane. The molten aluminum alloy was alloy 5182 containing 4 to 5% magnesium and 0.2 to 0.5% manganese, said alloy being widely used in tear open beverage can ends and readily available as scrap containing substantial amounts of impurities. The practice in accordance with U.S. Pat. No. 3,737,305 was found to markedly improve the quality of the aluminum passing therethrough to render it suitable for casting into ingot for rolling into sheet suitable for can end use. However, as the process was used a gradual buildup in molten metal head across baffle 16 was observed and the process was interrupted after 160 hours because of head buildup.

The fine mesh particles and alumina balls were removed from the vessel and replaced with ½-inch Raschig rings made of alumina and having situated thereupon one layer of ¾-inch alumina balls as shown in FIG. 1. The same type 5182 molten aluminum metal of high contamination was run through this unit practicing the present invention which provided the same superior metal purification as achieved with the process of U.S. Pat. No. 3,737,305 such that the metal exiting through exit 21 exhibited markedly reduced amounts of gas, nonmetallic impurity and trace element content. However, in practicing the improvement with the ring contact media, there was no buildup observed even after an extended run of 750 hours whereupon the process was interrupted for reasons having nothing to do with the process. During this run the high gas rate periodic purge was employed at a gas rate of 0.2 SCFH per square inch of bed cross section in the horizontal plane which amounts to about four times that used for the normal metal treatment. In each instance the periodic purge was employed during a period of interruption in metal flow because of casting interruption. No other maintenance or adjustment to the molten metal treatment process was necessary during this period and the molten metal flow rate, quality and all characteristics were the same after 750 hours as during the first hour of operation which verifies the marked improvement in operability of the present improvement.

While the invention has been described in terms of preferred embodiments, the claims appended hereto are intended to encompass all embodiments which fall within the spirit of the invention.

What is claimed is:

1. A method of treating molten metal containing suspended particles to remove said particles from said metal comprising:

(a) passing said metal through a medium of submerged contacting surfaces selected to avoid introduction of unwanted contaminants into said metal, said medium having an average void fraction of at least one-half and a specific surface area of at least 25 sq. ft. per cubic ft.; and (b) periodically passing a gas through said medium at a sufficient rate to:

(i) disturb said medium to dislodge therefrom particles previously removed from molten metal passing through said medium and retained in said medium; and (ii) disrupt said molten metal treatment, said periodic passing of gas prolonging the useful life of said medium in said treatment.

2. The method according to claim 1 wherein said void fraction is 0.7 or more.

3. The method according to claim 1 wherein said specific surface area is 50 square feet or more.

4. The method according to claim 2 wherein said specific surface area is 75 square feet or more.

5. The method according to claim 1 wherein said void fraction is 0.7 or more and said specific surface area is 50 square feet or more.

6. The method according to claim 1 wherein said superficial metal velocity is one half ft./minute or less.

7. The method according to claim 1 wherein said molten metal moving through said submerged contacting surfaces in said step (a) is continuously contacted with a gas at a rate substantially less than that used in said step (b) of Claim 1.

8. The method according to claim 7 wherein said gas moves in counterflow relationship with said molten metal.

9. The method according to claim 7 wherein said gas moves in concurrent flow relationship with said molten metal.

10. The method of Claim 1 wherein in said step (a) a gas is continuously passed through said medium but at a rate not greater than one-half of that used in said step (b) of Claim 1.

11. The method according to claim 1 wherein molten metal movement through said medium is interrupted during said gas passage in said step (b).

12. The method according to claim 1 wherein said media comprises saddle-shaped bodies.

13. The method according to claim 1 wherein said media comprises ring-shaped bodies.

14. The method according to claim 1 wherein upward media movement is restrained by means situated upon said media.

15. A method of treating molten aluminum for removal therefrom of gas and nonmetallic particle impurities comprising:

(a) passing said molten aluminum through a medium of submerged contacting surfaces selected to avoid introduction of unwanted contaminants into said metal, said medium having an average void fraction of at least one-half and a specific surface area of at least 25 sq. ft. per cu. ft.;

(b) moving a gas through said medium in contact with said molten aluminum passing therethrough said gas moving through said medium at a first rate of flow; thereby removing from said molten aluminum particles which attach to contacting surfaces in said media; and (c) periodically interrupting the flow of molten aluminum through said contact media while purging said media by passing a gas therethrough at a rate exceeding said first rate and sufficient to disturb said media and dislodge particles previously removed from said molten aluminum and retained in said media causing said particles to rise upwardly out of said media.

* * * * *